US011655992B2

(12) United States Patent
Tsai et al.

(10) Patent No.: US 11,655,992 B2
(45) Date of Patent: May 23, 2023

(54) MEASURING SYSTEM

(71) Applicant: Advanced Semiconductor Engineering, Inc., Kaohsiung (TW)

(72) Inventors: Chun Hung Tsai, Kaohsiung (TW); Hsuan Yu Chen, Kaohsiung (TW)

(73) Assignee: ADVANCED SEMICONDUCTOR ENGINEERING, INC., Kaohsiung (TW)

( * ) Notice: Subject to any disclaimer, the term of this patent is extended or adjusted under 35 U.S.C. 154(b) by 286 days.

(21) Appl. No.: 15/895,701

(22) Filed: Feb. 13, 2018

(65) Prior Publication Data

US 2019/0249891 A1 Aug. 15, 2019

(51) Int. Cl.

| | |
|---|---|
| ***F24F 11/30*** | (2018.01) |
| ***F24F 1/04*** | (2011.01) |
| ***F24F 1/022*** | (2019.01) |
| *F24F 110/10* | (2018.01) |
| *F24F 11/80* | (2018.01) |
| *F24F 13/24* | (2006.01) |

(52) U.S. Cl.

CPC ..... *F24F 11/30* (2018.01); *F24F 1/022* (2013.01); *F24F 1/04* (2013.01); *F24F 11/80* (2018.01); *F24F 2013/247* (2013.01); *F24F 2110/10* (2018.01)

(58) Field of Classification Search

CPC . F24F 11/70; F24F 11/80; F24F 11/30; G01C 11/04; G01J 2001/444; G01J 1/0228; G01J 1/0295; G01J 2001/083; G01J 2001/086

See application file for complete search history.

(56) References Cited

U.S. PATENT DOCUMENTS 4,299,092 A * 11/1981 Ibrahim ..... F25D 21/125 62/256
4,361,012 A * 11/1982 Ibrahim ..... A47F 3/0408 62/255
5,805,968 A * 9/1998 Chatterjee ..... C04B 35/486 399/324
5,871,878 A * 2/1999 Chatterjee ..... G03G 15/2025 430/105
5,941,170 A * 8/1999 Davis ..... G03G 15/6558 100/328

(Continued)

FOREIGN PATENT DOCUMENTS

| | | |
|---|---|---|
| CN | 206095442 U | 4/2017 |
| EP | 3 279 749 A1 | 2/2018 |
| TW | M417442 U1 | 12/2011 |

OTHER PUBLICATIONS

Office Action from corresponding Taiwanese Patent Application No. 107123676, dated Dec. 22, 2021, 9 pages.

(Continued)

*Primary Examiner* — Devon Russell
(74) *Attorney, Agent, or Firm* — Foley & Lardner LLP

(57) ABSTRACT

A measuring system includes a temperature-variable container, an optical device and an air conditioner. The temperature-variable container includes a transparent plate. The optical device includes a first optical sensor unit and a second optical sensor unit. The air conditioner is disposed between the transparent plate and the optical device.

20 Claims, 9 Drawing Sheets
(1 of 9 Drawing Sheet(s) Filed in Color)

(56) References Cited

U.S. PATENT DOCUMENTS 6,151,904 A * 11/2000 Jin ..... A47F 3/0434 454/198
8,635,877 B2 * 1/2014 Kim ..... F25C 5/187 62/137
10,001,288 B1 * 6/2018 Yang ..... F24F 13/10
10,151,635 B1 * 12/2018 Trent ..... G01J 5/10
10,412,283 B2 * 9/2019 Send ..... H04N 5/2251
10,648,721 B2 * 5/2020 Temizkan ..... F25C 5/187
2001/0005991 A1 * 7/2001 Niimi ..... B60H 1/3208 62/133
2001/0049943 A1 * 12/2001 Nakamura ..... B60H 1/3207 62/176.6
2002/0057438 A1 * 5/2002 Decker ..... G01B 11/2509 356/601
2002/0070494 A1 * 6/2002 Milillo ..... B65H 3/0816 271/98
2002/0121132 A1 * 9/2002 Breed ..... B60C 11/24 73/146
2002/0149762 A1 * 10/2002 Ditto ..... G01B 11/00 356/5.09
2003/0131613 A1 * 7/2003 Mardberg ..... B60H 1/00878 62/155
2004/0126062 A1 * 7/2004 Shin ..... G02B 6/0218 385/37
2005/0006084 A1 * 1/2005 Yonekura ..... B60H 1/3207 165/202
2007/0089524 A1 * 4/2007 Walchli ..... G01L 9/0079 73/718
2012/0290259 A1 * 11/2012 McAfee ..... G01B 5/0004 702/155
2014/0260360 A1 * 9/2014 Rasch ..... H05B 3/84 62/80
2015/0211852 A1 7/2015 Park et al.
2017/0167967 A1 * 6/2017 Bugher ..... G01N 17/002
2017/0254593 A1 * 9/2017 Gallagher ..... F27D 99/0033

OTHER PUBLICATIONS

Search Report with English translation from corresponding Taiwanese Patent Application No. 107123676, dated Dec. 22, 2021, 2 pages.

* cited by examiner

MEASURING SYSTEM

BACKGROUND

1. Technical Field

The present disclosure relates to a measuring system, and to a measuring system including a temperature-variable container, an optical device and an air conditioner.

2. Description of the Related Art

A semiconductor device package may undergo certain reliability tests. For example, the semiconductor device package may be placed in a temperature-variable environment (e.g. an oven) for subsequent observation. An optical device (e.g. a digital image correlation (DIC) device) may be used to obtain images of the semiconductor device package during thermal cycles. The temperature-variable environment may be equipped with a transparent plate or a window to facilitate taking images of the semiconductor device package. However, convection (e.g. heat convection) between the optical device and the window may adversely affect images obtained by the optical device (e.g. image deviation, distortion, etc.).

SUMMARY

In one or more embodiments, a measuring system includes a temperature-variable container, an optical device and an air conditioner. The temperature-variable container includes a transparent plate. The optical device includes a first optical sensor unit and a second optical sensor unit. The air conditioner is disposed between the transparent plate and the optical device.

In one or more embodiments, a temperature-variable container includes a transparent plate and an air conditioner adjacent to the transparent plate.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Common reference numerals are used throughout the drawings and the detailed description to indicate the same or similar elements. Embodiments of the present disclosure will be readily apparent from the following detailed description taken in conjunction with the accompanying drawings.

DETAILED DESCRIPTION

Spatial descriptions, such as "above," "below," "up," "left," "right," "down," "top," "bottom," "vertical," "horizontal," "side," "higher," "lower," "upper," "over," "under," and so forth, are indicated with respect to the orientation shown in the figures unless otherwise specified. It should be understood that the spatial descriptions used herein are for purposes of illustration, and that practical implementations of the structures described herein can be spatially arranged in any orientation or manner, provided that the merits of embodiments of this disclosure are not deviated from by such arrangement.

Figure 1:
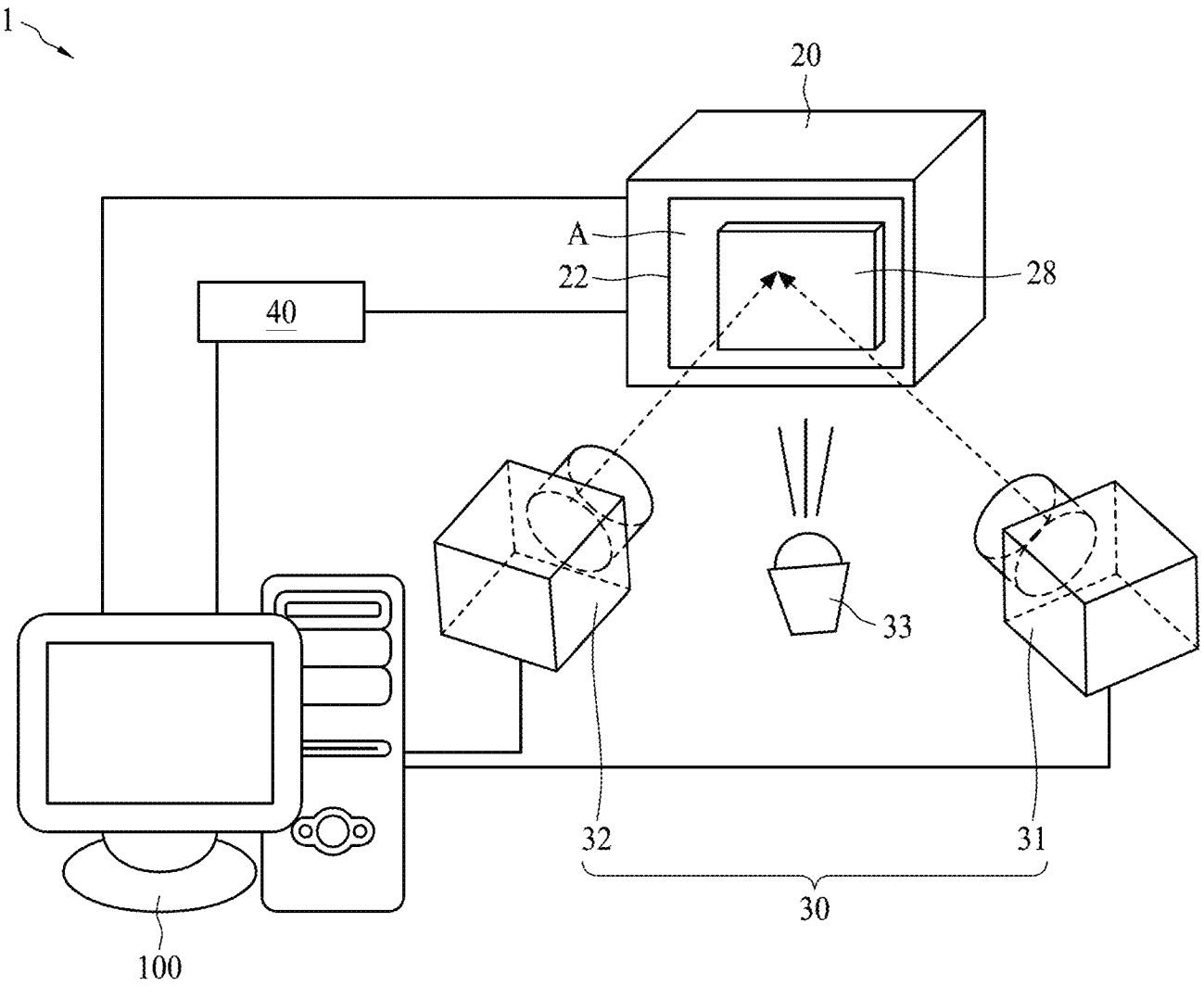
FIG. 1 is a schematic diagram of a measuring system in accordance with some embodiments of the present disclosure.

FIG. 1 is a schematic diagram of a measuring system 1 in accordance with some embodiments of the present disclosure. The measuring system 1 includes a temperature-variable container 20, a computer 100, an optical device 30 and an air conditioner 40.

The temperature-variable container 20 includes a transparent plate 22 and defines a space A for accommodating an object 28 to be measured. The optical device 30 includes an optical sensor unit 31 and an optical sensor unit 32. The light source 33 emits the light towards the object 28. In some embodiments, the object 28 may be or may include, for example, a wafer, a chip or a die. In some embodiments, the optical sensor unit 31 is a local camera and the optical sensor unit 32 is a global camera. The optical sensor unit 31 captures a plurality of local images of a plurality of local areas of the object 28. The optical sensor unit 32 captures a global image of the object 28 (e.g. of an entire surface of the object 28). The global image and the local images can be approximately simultaneously captured and transmitted to the computer 100. The global image and the local images can be processed and calculated by the computer 100 to obtain the images of the object 28 (including, for example, image deviation, distortion, and so forth). In some embodiments, the computer 100 may be a control unit including a processor and an associated memory. The computer 100 is connected to the temperature-variable container 20, the optical device 30, and the air conditioner 40 to direct operation of these components. In contrast to a single image detecting device, the local and global images captured simultaneously by two different optical sensor units 31 and 32 can provide an improved stereoscopic view (including in-plane deformation, distortion and warpage of the object 28).

Figure 2:
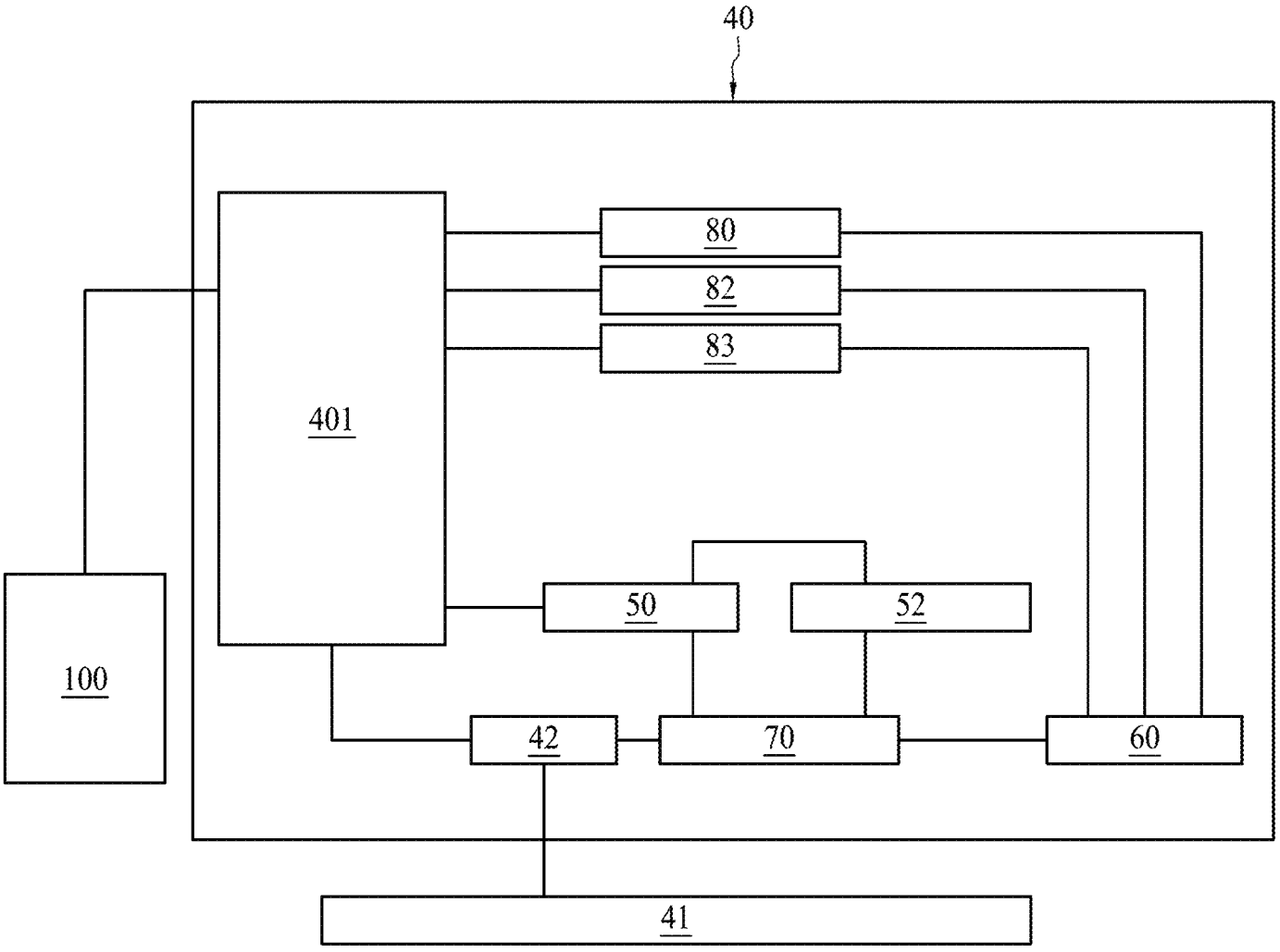
FIG. 2 is a schematic diagram of an air conditioner in accordance with some embodiments of the present disclosure.

FIG. 2 is a schematic diagram of the air conditioner 40 in accordance with some embodiments of the present disclosure. The air conditioner 40 includes a processor 401, a vent valve 42, a temperature controlling device 50, a temperature sensor 52, an air ventilation unit 60, a pipe 70, a moving mechanism 80, a moving mechanism 82 and a moving mechanism 83. The processor 401 is wirelessly connected to the computer 100 and controlled by one or more signals generated by the computer 100. In some embodiments, the processor 401 is connected to the computer 100 by a wired connection. A gas supply 41 is connected to the air ventilation unit 60 of the air conditioner 40 through the pipe 70. In some embodiments, the gas supply 41 may supply an air flow to the air conditioner 40. The vent valve 42 is controlled by the processor 401. The vent valve 42 adjusts the amount of the air flow from the gas supply 41 based on the image quality captured by the optical device 30 or a signal associated with optical information. In some embodiments, the vent valve 42 adjusts the amount of the air flow based on temperature information of the temperature-variable container 20. In some embodiments, the processor 401 controls the vent valve 42 to increase the amount of the air flow from the gas supply 41 when the maximum measured error of measured values of the warpage of an object 28 exceeds a threshold value of about 10 micrometers (μm) (e.g. exceeds about 12 exceeds about 14 or exceeds about 16 μm). In some embodiments, the processor 401 controls the vent valve 42 to increase the amount of the air flow from the gas supply 41 when the maximum measured error of measured values of the warpage of an object 28 exceeds a threshold value of about 50 μm (e.g. exceeds about 55 exceeds about 60 or exceeds about 65 μm).

The temperature controlling device 50 and temperature sensor 52 are controlled by the processor 401. The temperature controlling device 50 controls a temperature of the air flow in the pipe 70 based on the temperature sensed by the temperature sensor 52. In some embodiments, the temperature controlling device 50 controls a temperature of an air flow ventilated from the air conditioner 40. The air flow is supplied to the air ventilation unit 60 through the pipe 70. The moving mechanism 80, 82 or 83 is controlled by the processor 401. The moving mechanism 80, 82 or 83 controls the angle or direction of the air flow ventilated from the air ventilation unit 60. In some embodiments, the moving mechanism 80, 82 or 83 controls the angle or direction of the air flow ventilated from the air ventilation unit 60 when the maximum measured error of measured values of the warpage of an object 28 exceeds a threshold value of about 10 μm (e.g. exceeds about 12 μm, exceeds about 14 μm, or exceeds about 16 μm). In some embodiments, the moving mechanism 80, 82 or 83 controls the angle or direction of the air flow ventilated from the air ventilation unit 60 when the maximum measured error of measured values of the warpage of an object 28 exceeds a threshold value of about 50 μm (e.g. exceeds about 55 μm, exceeds about 60 μm, or exceeds about 65 μm). The moving mechanism 80, 82 or 83 controls the position or rotated angle of the air ventilation unit 60, and can be implemented as one or more actuators. The air provided by the air conditioner 40 may neutralize or mitigate convection above the transparent plate 22 shown in FIG. 1. The convection due to the increasing of the temperature of the space A of the temperature-variable container 20 may affect the measured result of the optical device 30. The heat convection may cause the maximum measured errors to exceed about 110 μm.

Figure 3:
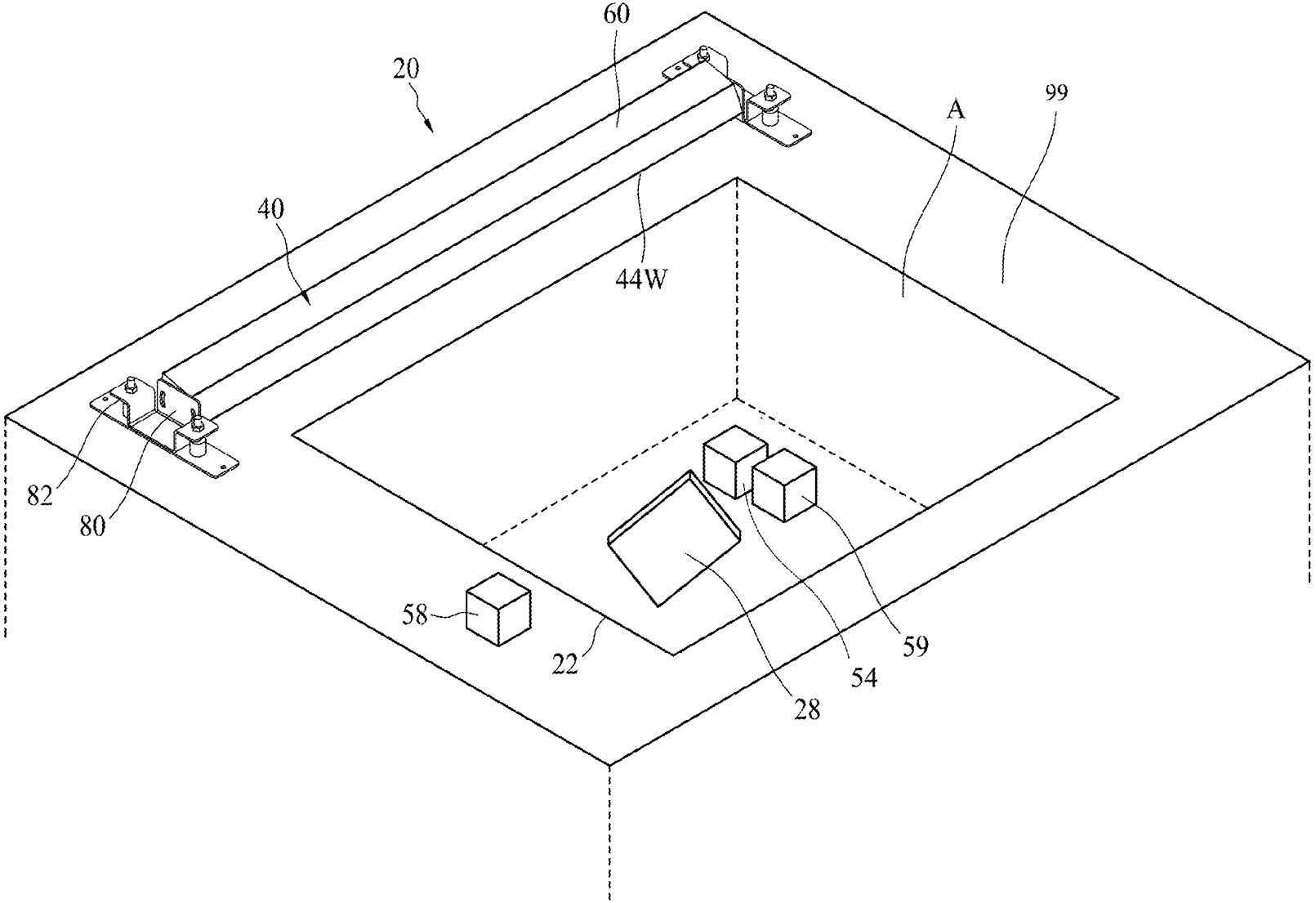
FIG. 3 is a schematic diagram of a side-sectional view of a temperature-variable container in accordance with some embodiments of the present disclosure.

FIG. 3 is a schematic diagram of a side-sectional view of a temperature-variable container 20 in accordance with some embodiments of the present disclosure. The temperature-variable container 20 includes a housing 99 defining the space A, and the transparent plate 22 is affixed to the housing 99. The temperature-variable container 20 may include a temperature controlling device 54. In some embodiments, the temperature controlling device 54 may control the temperature within the space A of the temperature-variable container 20. In some embodiments, the temperature controlling device 54 may be a heater, which can heat the temperature within the space A of the temperature-variable container 20. The temperature within the space A of the temperature-variable container 20 can range from about 20 degrees Celsius (° C.) to about 280° C. In some embodiments, the temperature controlling device 54 may be cooler, which can cool the temperature within the space A of the temperature-variable container 20. In some embodiments, the temperature within the space A of the temperature-variable container 20 can range from about −10° C. to about 10° C. The object 28 to be measured is disposed within the space A of the temperature-variable container 20.

The air ventilation unit 60 of the air conditioner 40 is disposed on the temperature-variable container 20. In some embodiments, the air ventilation unit 60 of the air conditioner 40 is disposed on the transparent plate 22 of the temperature-variable container 20. The optical device 30 is disposed above the temperature-variable container 20 (not shown). In some embodiments, the air conditioner 40 is disposed between the transparent plate 22 and the optical device 30.

Figure 4A:
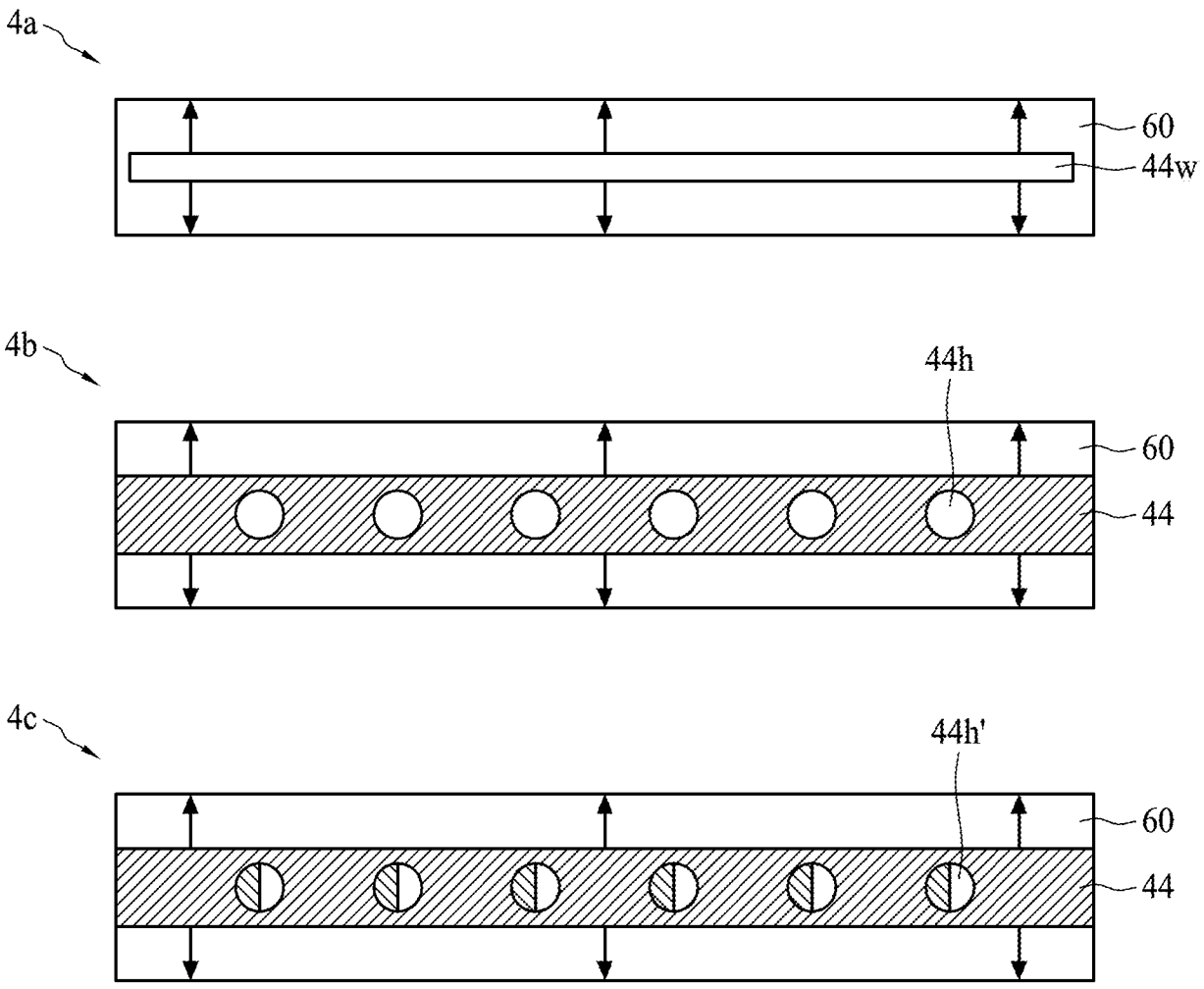
FIG. 4A is a schematic diagram of a side-sectional view of an air ventilation unit in accordance with some embodiments of the present disclosure.

The air ventilation unit 60 defines at least one hole 44*w*. In some embodiments, the air ventilation unit 60 may be a wind knife. The air flow is ventilated from the hole 44*w* of the air ventilation unit 60. In some embodiments, the air ventilation unit 60 may include a baffle unit 44 defining a plurality of holes 44*h* (e.g. as shown in FIG. 4A). The moving mechanism 82 is operated to move the air conditioner 40 toward or away from the transparent plate 22. In some embodiments, the moving mechanism 82 is operated to move the air ventilation unit 60 toward or away from the transparent plate 22. In some embodiments, the moving mechanism 82 is operated to move the baffle unit 44 toward or away from the transparent plate 22. In some embodiments, the air conditioner 40 comprising, for example, a wind knife, and/or a spray gun, may reduce or eliminate the vibration of the transparent plate 22 thereby improving accuracy/quality of the obtained images.

The moving mechanism 80 is operated to rotate the air conditioner 40. In some embodiments, the moving mechanism 80 is operated to rotate the air ventilation unit 60 of the air conditioner 40. In some embodiments, the moving mechanism 80 is operated to rotate the baffle unit 44. In some embodiments, a distance between the hole 44*w* of the wind knife and the transparent plate 22 is in a range from approximately 1 centimeter (cm) to approximately 5 cm.

In some embodiments, the air conditioner 40 is disposed adjacent to the transparent plate 22. In some embodiments, the transparent plate 22 may be, for example, a glass plate. A sensor 58 is disposed external to the temperature-variable container 20 and adjacent to the transparent plate 22. The sensor 58 senses a temperature T1 above the transparent plate 22. In some embodiments, sensor 58 senses a temperature T2 of the transparent plate 22. A sensor 59 is disposed within the temperature-variable container 20. The sensor 59 senses a temperature T3 in the space A of the temperature-variable container 20. In some embodiments, the temperature, volume, speed or angle of an air flow ventilated from the air conditioner 40 is controlled by the computer 100 based on one or more signals detected by the sensor 58 or the sensor 59. The volume and speed can be increased when the temperature of the temperature-variable container 20 is increasing. The volume and speed can be decreased when the temperature of the temperature-variable container 20 is decreasing. In some embodiments, the temperature, volume, speed or angle of an air flow ventilated from the air conditioner 40 is controlled by the computer 100 based on image quality captured by the optical device 30 or a signal associated with optical information. In some embodiments, if the maximum measured errors (such as measured errors for warpage, deformation or strain) of an object 28 exceeds a threshold value of about 10 μm (e.g. exceeds about 12 exceeds about 14 or exceeds about 16 μm), the volume, speed or angle of an air flow ventilated from the air conditioner 40 will be controlled by the computer 100 to neutralize or mitigate the heat convection above the transparent plate 22.

In some embodiments, the air flow is controlled to have a temperature in a range from approximately 40° C. to approximately 60° C. In some embodiments, the air flow is controlled to have a temperature in a range from approximately −10° C. to approximately 20° C. The temperature/speed/volume/angle of the air flow ventilated from the hole 44*w* is adjustable (e.g. based on temperature of the transparent plate 22 or temperature in the temperature-variable container 20 or image quality).

FIG. 4A is a schematic diagram of a side-sectional view of an air ventilation unit 60 in accordance with some embodiments of the present disclosure. A depicted structure 4*a* of the air ventilation unit 60 may be a wind knife. An air flow is ventilated from the hole 44*w* of the air ventilation unit 60. The hole 44*w* may be moved upward or downward by a moving mechanism 83. The moving mechanism 83 is disposed within the air ventilation unit 60 and is not shown in FIG. 4A. A depicted structure 4*b* of the air ventilation unit 60 includes a baffle unit 44 defining a plurality of holes 44*h*. The baffle unit is formed integrally (e.g. as a monolithic structure). An air flow is ventilated from the plurality of holes 44*h*. The baffle unit 44 may be moved upward or downward by the moving mechanism 83. A depicted structure 4*c* of the air ventilation unit 60 includes a baffle unit 44 defining a plurality of holes 44W. The holes 44W are partially blocked. The baffle unit 44 may be moved upward or downward by the moving mechanism 83. Any one or more of the structures 4*a*, 4*b*, and 4*c* can be implemented with the air ventilation unit 60.

Figure 4B:
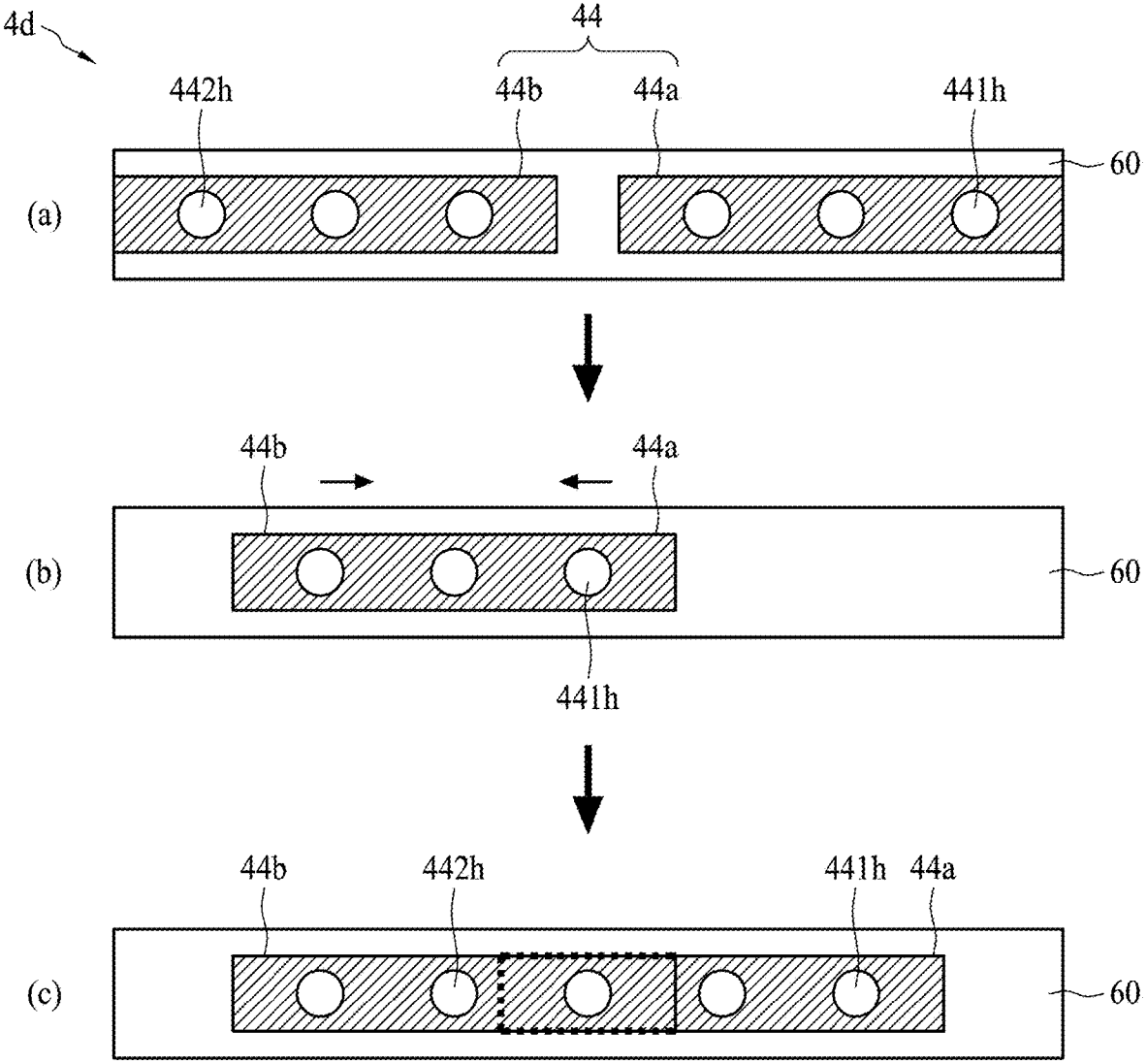
FIG. 4B is a schematic diagram of a side-sectional view of an air ventilation unit in accordance with some embodiments of the present disclosure.

FIG. 4B is a schematic diagram of a side-sectional view of an air ventilation unit 60 in accordance with some embodiments of the present disclosure. A depicted structure 4*d* of the air ventilation unit 60 includes a baffle unit 44 defining a plurality of holes 44*h*. The baffle unit 44 includes a portion 44*a* and a portion 44*b* separated from each other. The portions 44*a* and 44*b* may be moved by the moving mechanism 83. The portion 44*a* defines a plurality of holes 441*h* of the plurality of holes 44*h* and the portion 44*b* defines a plurality of holes 442*h* of the plurality of holes 44*h*. The portion 44*a* moves relative to the portion 44*b*. In a depicted state (a), the portion 44*a* and the portion 44*b* are separated from each other. In a depicted state (b), the portion 44*a* moves toward the portion 44*b*. The location of the holes 441*h* of the portion 44*a* is overlapped with the location of the holes 442*h* of the portion 44*b*. In a depicted state (c), one of the holes 441*h* of the portion 44*a* is overlapped with one of the holes 442*h* of the portion 44*b*.

Figure 5:
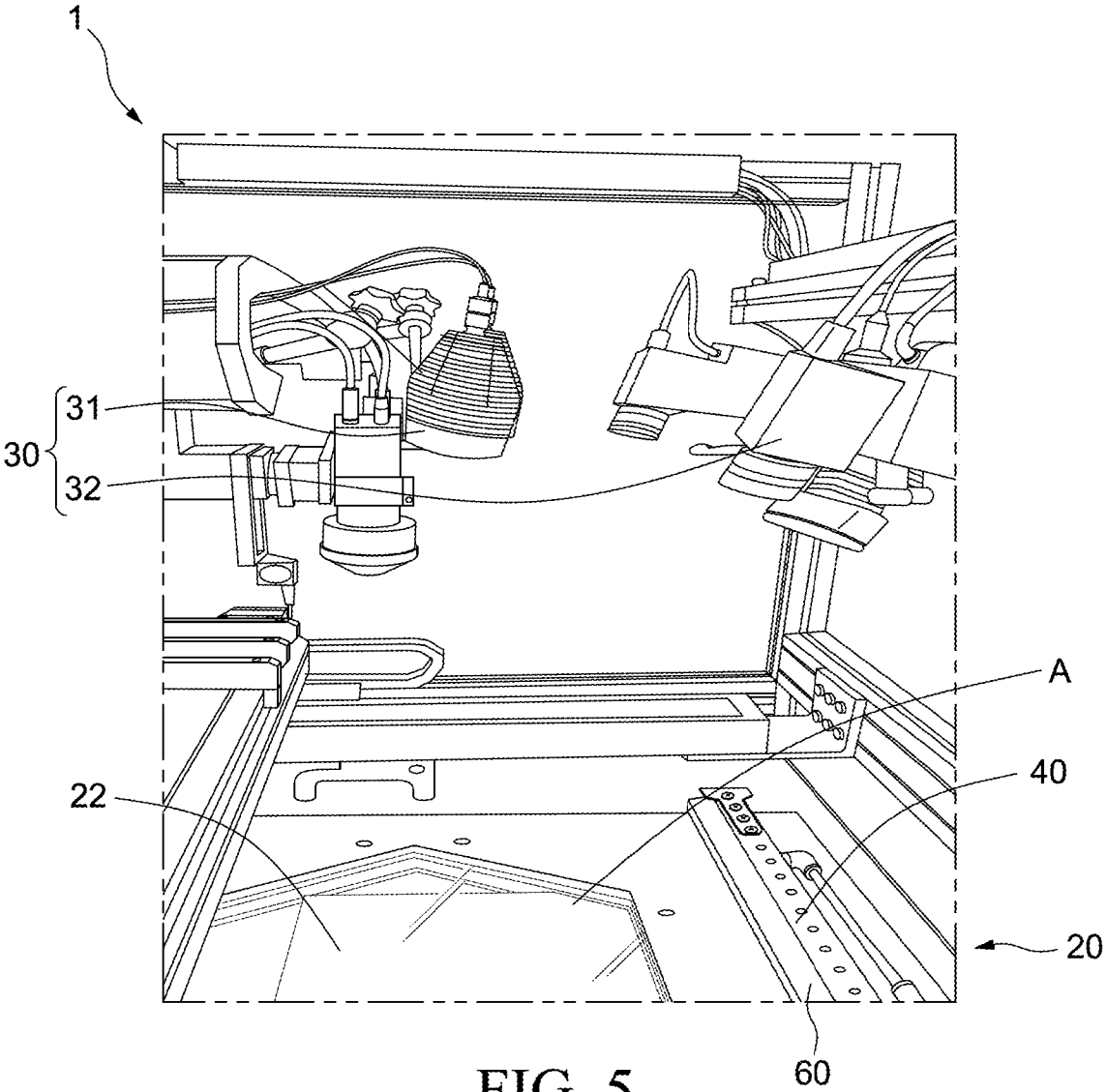
FIG. 5 is a depiction of a measuring system in accordance with some embodiments of the present disclosure.

FIG. 5 is depiction of a measuring system 1 in accordance with some embodiments of the present disclosure. The measuring system 1 includes a temperature-variable container 20, a computer 100 (not shown), an optical device 30 and an air conditioner 40. The air conditioner 40 is disposed between a transparent plate 22 and the optical device 30. An air ventilation unit 60 of the air conditioner 40 is disposed adjacent to the transparent plate 22. The transparent plate 22 is not covered by the air ventilation unit 60 of the air conditioner 40. The air conditioner 40 is disposed between the optical device 30 and the transparent plate 22.

Figure 6:
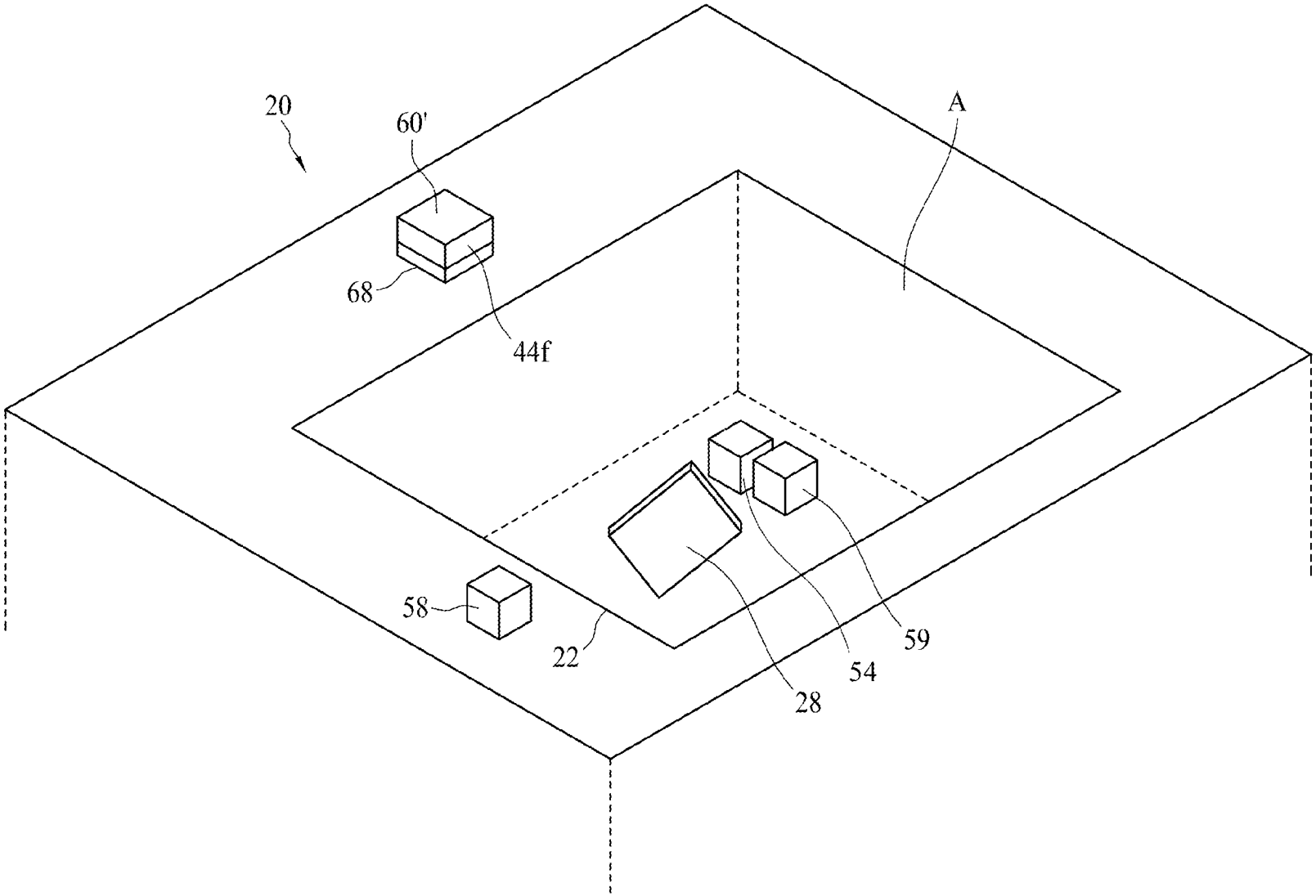
FIG. 6 is a depiction of a side-sectional view of a temperature-variable container in accordance with some embodiments of the present disclosure.

FIG. 6 is a schematic diagram of a side-sectional view of a temperature-variable container 20 in accordance with some embodiments of the present disclosure. An air ventilation unit 60' is disposed adjacent to a transparent plate 22. In some embodiments, the air ventilation unit 60' may be a fan defining a hole 44*f*. An air flow is ventilated from the hole 44*f*. The air ventilation unit 60' includes an absorber 68. The absorber 68 is disposed on a bottom of the air ventilation unit 60'. A vibration may be generated when the fan is operating. The vibration may affect the measuring results of the optical device 30 and cause measurement errors. The absorber 68 below the fan may receive and dissipate the vibration generated by the fan and help to reduce the measurement errors. The absorber 68 may include, for example, an elastomer or another shock absorbing material.

Figure 7A:
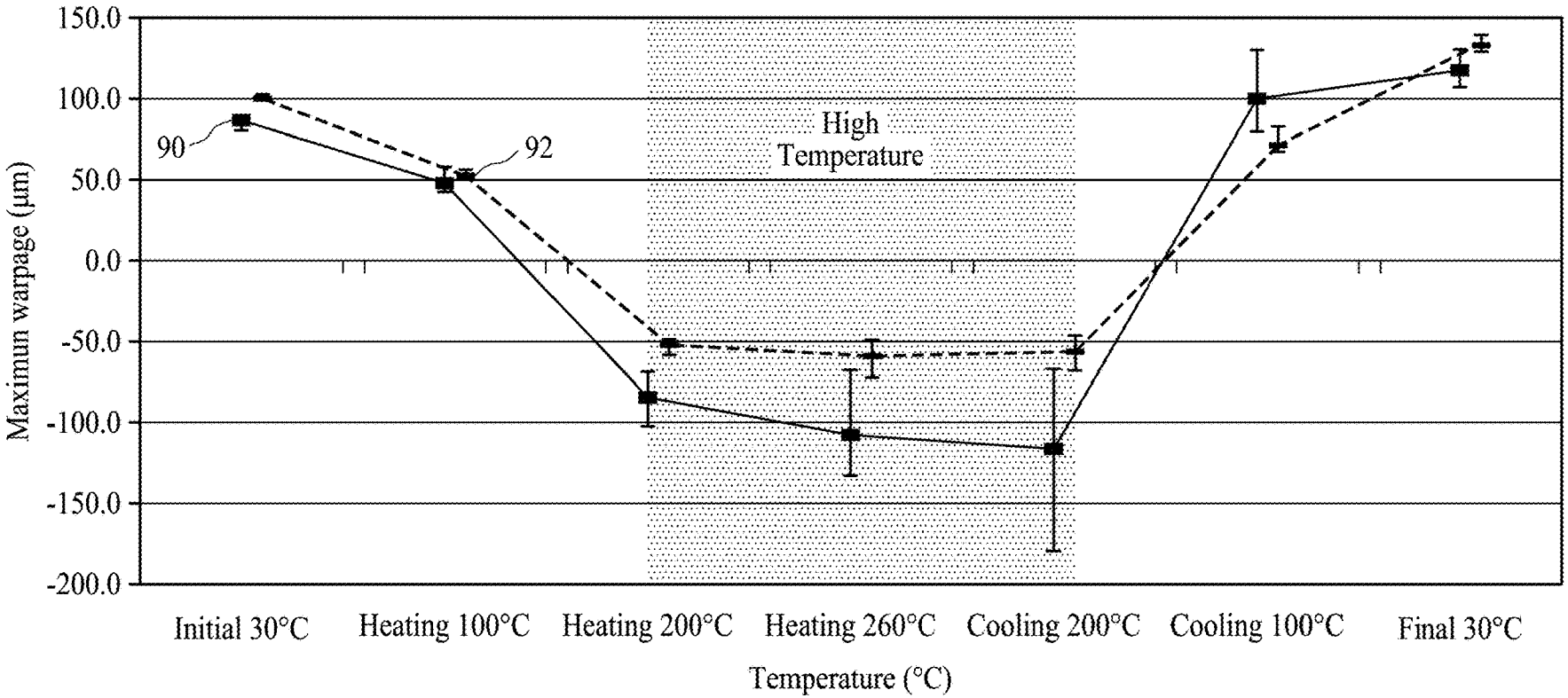
FIG. 7A is a plot of the warpage of an object to be measured in accordance with some embodiments of the present disclosure.

FIG. 7A is a plot of the warpage of an object 28 to be measured in accordance with some embodiments of the present disclosure. The temperatures along the x-axis ranging from 30° C. to 260° C. correspond to a heating temperature within the space A of the temperature-variable container 20. The temperatures ranging from 260° C. to 30° C. along the x-axis correspond to the cooling temperature within the space A of the temperature-variable container 20. The plot 90 represents the warpage of an object 28 without air flow ventilated from the air ventilation unit 60. The maximum measured errors in the plot 90 appears when the space A of the temperature-variable container 20 is cooling from temperature the 260° C. to 200° C. The maximum measured errors in the plot 90 exceed 110 μm. The plot 92 represents the warpage of an object 28 with air flow ventilated from the air ventilation unit 60. The maximum measured errors in the plot 92 appears when the space A of the temperature-variable container 20 is cooling from temperature the 260° C. to 200° C. The maximum measured errors in the plot 92 are less than 10 μm.

Figure 7B:
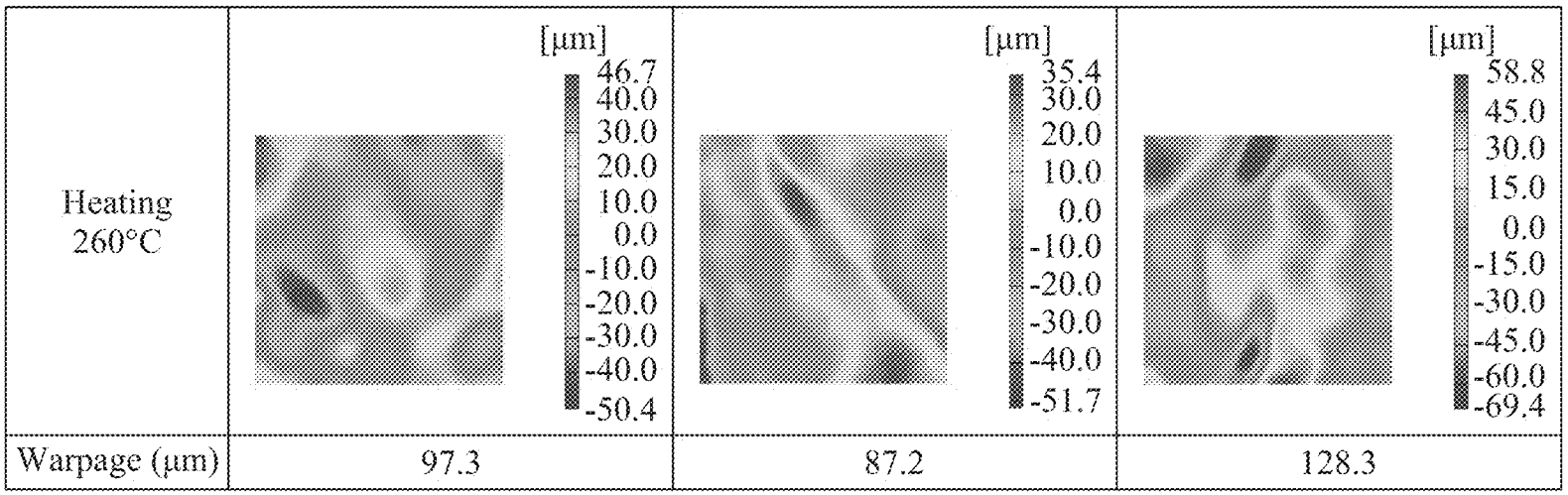
FIG. 7B and FIG. 7C are diagrams showing warpage of an object to be measured in accordance with some embodiments of the present disclosure.
Figure 7C:
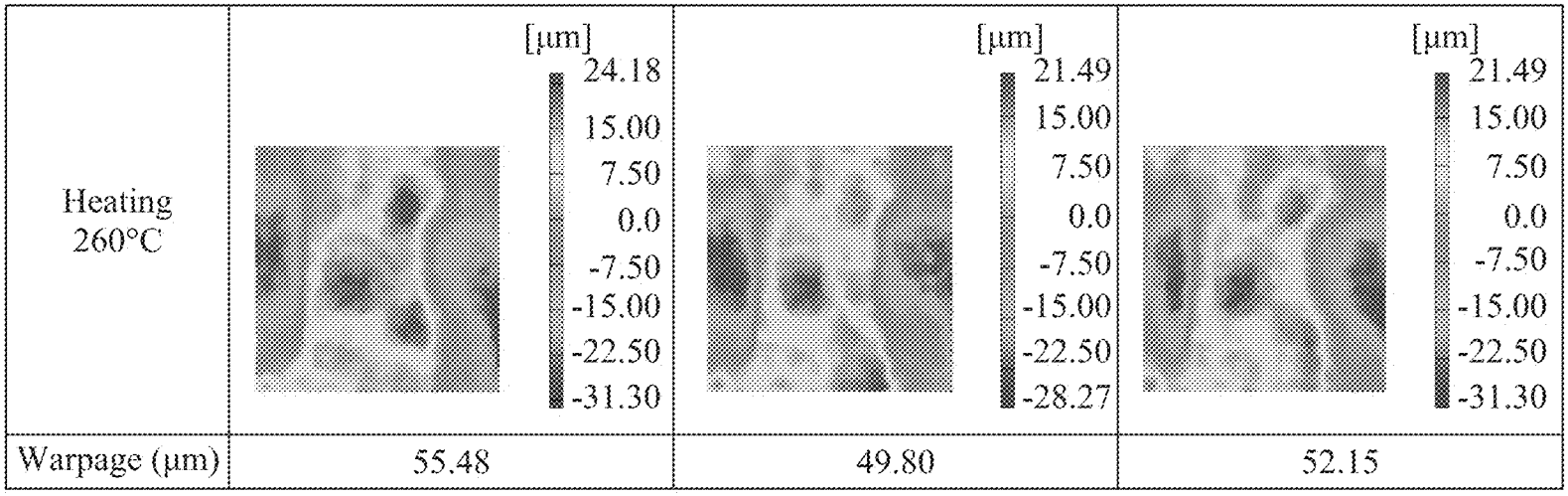

FIG. 7B and FIG. 7C are diagrams showing warpage of an object 28 to be measured in accordance with some embodiments of the present disclosure. The diagram of FIG. 7B represents measured values of the warpage of an object 28 without air flow ventilated from the air ventilation unit 60 when heating is at about 260° C. The maximum measured error is about 41.1 μm (128.3 μm-87.2 μm). The diagram of FIG. 7C represents measured values of the warpage of an object 28 with air flow ventilated from the air ventilation unit 60 when heating is at about 260° C. The maximum measured error is about 5.68 μm (55.48 μm-49.8 μm). Thus, use of the air flow ventilated from the air ventilation unit 60 can reduce the maximum error.

As used herein, the terms "approximately," "substantially," "substantial" and "about" are used to describe and account for small variations. When used in conjunction with an event or circumstance, the terms can refer to instances in which the event or circumstance occurs precisely as well as instances in which the event or circumstance occurs to a close approximation. For example, when used in conjunction with a numerical value, the terms can refer to a variation of less than or equal to ±10% of the numerical value, such as less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%. Thus, the term "approximately equal" in reference to two values can refer to a ratio of the two values being within a range between and inclusive of 0.9 and 1.1.

Additionally, amounts, ratios, and other numerical values are sometimes presented herein in a range format. It is to be understood that such range format is used for convenience and brevity and should be understood flexibly to include numerical values explicitly specified as limits of a range, but also to include all individual numerical values or sub-ranges encompassed within that range as if each numerical value and sub-range is explicitly specified.

As used herein, the singular terms "a," "an," and "the" may include plural referents unless the context clearly dictates otherwise. In the description of some embodiments, a component provided "on" or "over" another component can encompass cases where the former component is directly on (e.g., in physical contact with) the latter component, as well as cases where one or more intervening components are located between the former component and the latter component.

While the present disclosure has been described and illustrated with reference to specific embodiments thereof, these descriptions and illustrations do not limit the present disclosure. It should be understood by those skilled in the art that various changes may be made and equivalents may be substituted without departing from the true spirit and scope of the present disclosure as defined by the appended claims. The illustrations may not necessarily be drawn to scale. There may be distinctions between the artistic renditions in the present disclosure and the actual apparatus due to manufacturing processes and tolerances. There may be other embodiments of the present disclosure which are not specifically illustrated. The specification and drawings are to be regarded as illustrative rather than restrictive. Modifications may be made to adapt a particular situation, material, composition of matter, method, or process to the objective, spirit and scope of the present disclosure. All such modifications are intended to be within the scope of the claims appended hereto. While the methods disclosed herein have been described with reference to particular operations performed in a particular order, it will be understood that these operations may be combined, sub-divided, or re-ordered to form an equivalent method without departing from the teachings of the present disclosure. Accordingly, unless specifically indicated herein, the order and grouping of the operations are not limitations of the present disclosure.

What is claimed is:

1. A measuring system, comprising:

a temperature-variable container comprising:

a housing; and a transparent plate disposed on the housing, the housing and the transparent plate together defining a space accommodating an object;

a first optical sensor unit disposed external to the temperature-variable container and configured to capture a plurality of local images respectively located on a plurality of local areas of the object through the transparent plate;

a second optical sensor unit disposed external to the temperature-variable container and configured to capture an image of an entire surface of the object through the transparent plate; and an air conditioner configured to supply an air flow in a direction toward the transparent plate, wherein the air flow is supplied to mitigate a convection, generated by the increasing of a temperature of the space, between the first optical sensor unit and the transparent plate and between the second optical sensor unit and the transparent plate.

2. The measuring system of claim 1, wherein the temperature provided in the space within the temperature-variable container is higher than an ambient temperature external of the temperature-variable container.

3. The measuring system of claim 2, wherein a volume, a speed of the air flow supplied by the air conditioner is controlled based on detecting the variation of the temperature within the space of the temperature-variable container.

4. The measuring system of claim 3, wherein the volume or the speed of the air flow supplied from the air conditioner is increased when the temperature within the space of the temperature-variable container is increasing.

5. The measuring system of claim 4, wherein the air conditioner comprises a first temperature controlling device configured to control the temperature of the air flow supplied from the air conditioner.

6. The measuring system of claim 5, wherein the air flow is controlled to have a temperature in a range of approximately 40 degrees Celsius (° C.) to approximately 60° C., wherein the temperature-variable container further comprises a second temperature controlling device, wherein the temperature within the space is controlled by the temperature-variable container in a range from approximately 20° C. to approximately 280° C.

7. The measuring system of claim 2, wherein the air conditioner comprises a vent valve configured to increase an amount of the air flow from the air conditioner when the temperature of the space increases.

8. The measuring system of claim 1, wherein the first optical sensor unit and the second optical sensor unit are configured to simultaneously and respectively capture the image of the entire surface and the plurality of local images, wherein the image of the entire surface and the plurality of local images are transmitted to a computer and calculated and processed by the computer to obtain an distortion image of the object.

9. The measuring system of claim 1, wherein the air conditioner comprises an air ventilation unit, wherein the air ventilation unit is closer to the transparent plate than the first optical sensor unit or the second optical sensor unit is.

10. The measuring system of claim 9, wherein the air ventilation unit further comprises a wind knife, wherein the wind knife comprises at least one hole for providing the air flow, wherein a width of the at least one hole of the air ventilation unit is greater than a width of the transparent plate.

11. The measuring system of claim 9, wherein the air conditioner further comprises a moving mechanism arranged on two ends of the air ventilation unit.

12. The measuring system of claim 11, wherein the moving mechanism controls an angle or a direction of the air flow from the air ventilation unit.

13. A measuring system, comprising:

a temperature-variable container comprising:

a housing; and a transparent plate disposed on the housing, the housing and the transparent plate together defining a space accommodating an object;

at least one optical sensor unit disposed external to the temperature-variable container and configured to capture an image of the object via a first path passing through the transparent plate; and an air conditioner configured to supply an air flow via a second path, wherein the second path crosses the first path, wherein the second path is located between the transparent plate and the at least one optical sensor unit.

14. The measuring system of claim 13, wherein a light source emits a light toward the object in a third path, wherein the second path crosses the third path.

15. The measuring system of claim 13, wherein an angle formed between the third path and the transparent plate is greater than an angle formed between the first path and the transparent plate.

16. The measuring system of claim 13, further comprising a sensor disposed external to the temperature-variable container and adjacent to the second path, wherein the sensor is configured to sense a temperature adjacent to the transparent plate.

17. The measuring system of claim 13, wherein the air conditioner is closer to the transparent plate than the at least one optical sensor unit is.

18. A measuring system, comprising:

a temperature-variable container comprising:

a housing defining a space accommodating an object, wherein the space has a first temperature;

a first optical sensor unit disposed in an external region external to the temperature-variable container and configured to capture an image of the object via a first path, wherein the external region has a second temperature lower than the first temperature; and an air conditioner configured to supply an air flow in a direction, wherein the direction crosses the first path, wherein the air flow is supplied to mitigate a heat convection generated by a difference between the first temperature and the second temperature.

19. The measuring system of claim 18, wherein the air conditioner is closer to the temperature-variable container than the first optical sensor unit is.

20. The measuring system of claim 19, wherein a light source emits a light toward the object in a third path, wherein the direction crosses the third path.

* * * * *